US009496613B2

(12) United States Patent
Sawa

(10) Patent No.: US 9,496,613 B2
(45) Date of Patent: Nov. 15, 2016

(54) ANTENNA BOARD

(71) Applicant: KYOCERA Circuit Solutions, Inc., Yasu-shi, Shiga (JP)

(72) Inventor: Yoshinobu Sawa, Moriyama (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 43 days.

(21) Appl. No.: 14/603,626

(22) Filed: Jan. 23, 2015

(65) Prior Publication Data

US 2015/0214625 A1 Jul. 30, 2015

(30) Foreign Application Priority Data

Jan. 30, 2014 (JP) ..... 2014-016204
Oct. 27, 2014 (JP) ..... 2014-218221

(51) Int. Cl.
*H01Q 9/04* (2006.01)
*H01Q 5/25* (2015.01)
*H01Q 5/385* (2015.01)

(52) U.S. Cl.
CPC ..... *H01Q 5/25* (2015.01); *H01Q 5/385* (2015.01); *H01Q 9/045* (2013.01); *H01Q 9/0414* (2013.01)

(58) Field of Classification Search
CPC .. H01Q 9/0407; H01Q 5/385; H01Q 9/0414; H01Q 9/045
See application file for complete search history.

(56) References Cited

U.S. PATENT DOCUMENTS 4,151,532 A * 4/1979 Kaloi ..... H01Q 9/0407 343/700 MS
5,576,718 A * 11/1996 Buralli ..... H01Q 21/065 343/700 MS
7,486,239 B1 * 2/2009 Channabasappa ... H01Q 9/0414 343/700 MS
7,626,549 B2 * 12/2009 Channabasappa ... H01Q 9/0457 343/700 MS
2005/0151688 A1 * 7/2005 Khoo ..... H01Q 1/247 343/700 MS
2015/0091760 A1 * 4/2015 Sawa ..... H01Q 19/005 343/700 MS
2015/0194730 A1 * 7/2015 Sudo ..... H01Q 9/045 343/905

FOREIGN PATENT DOCUMENTS

JP 5-145327 A 6/1993

* cited by examiner

*Primary Examiner* — Trinh Dinh
(74) *Attorney, Agent, or Firm* — Volpe and Koenig, P.C.

(57) ABSTRACT

The antenna board of the present invention includes: a dielectric board where a plurality of dielectric layers are laminated, a ground conductor layer, a strip conductor, a first patch conductor, a second patch conductor, a third patch conductor, and a penetration conductor. The first patch conductor, the second patch conductor, and the third patch conductor are electrically independent of each other. The penetration conductor includes at least two penetration conductors aligned adjacent to each other in the extending direction of the strip conductor.

9 Claims, 15 Drawing Sheets

ANTENNA BOARD

BACKGROUND OF THE INVENTION

1. Field of the Invention

The present invention relates to an antenna board which is formed by laminating dielectric layers and conductor layers.

2. Description of Related Art

As indicated by the cross-sectional view and top view shown in FIGS. 14A and 14B, respectively, and the exploded perspective view shown in FIG. 15, for example, an antenna board includes a dielectric board 11 in which a plurality of dielectric layers 11*a* to 11*e* are laminated, a ground conductor layer 12 for shielding, a strip conductor 13 for inputting and outputting high-frequency signals, and a patch conductor 14 for transmitting and receiving electromagnetic waves.

The dielectric board 11 is, for example, formed by the five layers of the dielectric layers 11*a* to 11*e* being laminated vertically. The dielectric layers 11*a* to 11*e* are formed by, for example, a resin layer with glass cloth and a resin without glass cloth. The ground conductor 12 is deposited on the entire bottom surface of the dielectric layer 11*a* located on the bottom layer. The around conductor 12 includes, for example, copper. The strip conductor 13 is opposed to the ground conductor 12 across the dielectric layer 11*a*, and is disposed between the dielectric layers 11*a* and 11*b*. The strip conductor 13 is a narrow strip-shaped conductor extending in one direction from the outer peripheral edge to the central part in the inner part of the dielectric board 11, and includes an end part in the central part of the dielectric board 11. The strip conductor 13 includes, for example, copper.

The patch conductor 14 includes a first patch conductor 14*a*, a second patch conductor 14*b*, and a third patch conductor 14*c*. These patch conductors 14*a* to 14*c* have quadrangle shapes. The patch conductors 14*a* to 14*c* include, for example, copper.

The first patch conductor 14*a* is disposed between the dielectric layers 11*c* and 11*d* so as to cover the position of the end part 13*a* of the strip conductor 13. The first patch conductor 14*a* is connected to the end part 13*a* of the strip conductor 13 via a penetration conductor 15 penetrating the dielectric layer 11*c* and a penetration conductor 16 penetrating the dielectric layer 11*b*.

The second patch conductor 14*b* is disposed between the dielectric layers 11*d* and 11*e* so as to cover the position where the first patch conductor 14*a* is formed. The second patch conductor 14*b* is electrically independent. The third patch conductor 14*c* is disposed on the top surface of the dielectric layer 11*e* so as to cover the position where the second patch conductor 14*b* is formed. The third patch conductor 14*c* is electrically independent.

In this antenna board, when a high-frequency signal is supplied to the strip conductor 13, the signal is transmitted to the first patch conductor 14*a* via the penetration conductors 15 and 16. The signal is radiated as an electromagnetic wave to the outside via the first patch conductor 14*a*, the second patch conductor 14*b* and the third patch conductor 14*c*. By the way, the reason why the antenna board like this includes the electrically independent second patch conductor 14*b* and third patch conductor 14*c* as well as the first patch conductor 14*a* is that the bandwidth of the frequency band of the antenna can be widened by such a configuration. Such a conventional antenna board is described, for example, in Japanese Unexamined Patent Application Publication No. H5-145327.

However, for example, in the wireless personal area network, the frequency band to be used is different in each country, and it is required to cover the wide frequency band so that one antenna board is usable in the whole world. To achieve this, an antenna board with a frequency band further wider than the conventional antenna board is required to be provided.

SUMMARY

It is an object of the present invention to provide a wide band antenna board which is capable of transmitting and receiving a satisfactory signal in a wide frequency band.

The antenna board of the present invention includes: a first dielectric layer; a strip conductor disposed on a top surface of the first dielectric layer so as to have an end part, extending towards the end part; a ground conductor layer disposed on a bottom surface side of the first dielectric layer; a second dielectric layer laminated on a top surface side of the first dielectric layer and the strip conductor; a first patch conductor disposed on a top surface of the second dielectric layer so as to cover a position of the end part of the strip conductor; a third dielectric layer laminated on the second dielectric layer and the first patch conductor; a second patch conductor disposed on a top surface of the third dielectric layer so that at least part of the second patch conductor covers a position where the first patch conductor is formed, being electrically independent; a fourth dielectric layer laminated on the third dielectric layer and the second patch conductor; a third patch conductor disposed on a top surface of the fourth dielectric layer so that at least part of the third patch conductor covers a position where the second patch conductor is formed, being electrically independent; and a penetration conductor connecting the end part and the first patch conductor by penetrating the second dielectric layer, and the at least one penetration conductor includes at least two penetration conductors aligned adjacent to each other in the extending direction of the strip conductor.

According to the antenna board of the present invention, the penetration conductor formed to connect the end part of the strip conductor and the first patch conductor disposed across the second dielectric layer includes at least two penetration conductors aligned adjacent to each other in the extending direction of the strip conductor. Thus, by the at least two penetration conductors disposed in this manner, a complex resonance occurs satisfactorily in the first to third patch conductors. Therefore, it is possible to provide a broadband antenna board that can transmit and receive a satisfactory signal in a wide frequency band.

DETAILED DESCRIPTION

Figure 1A:
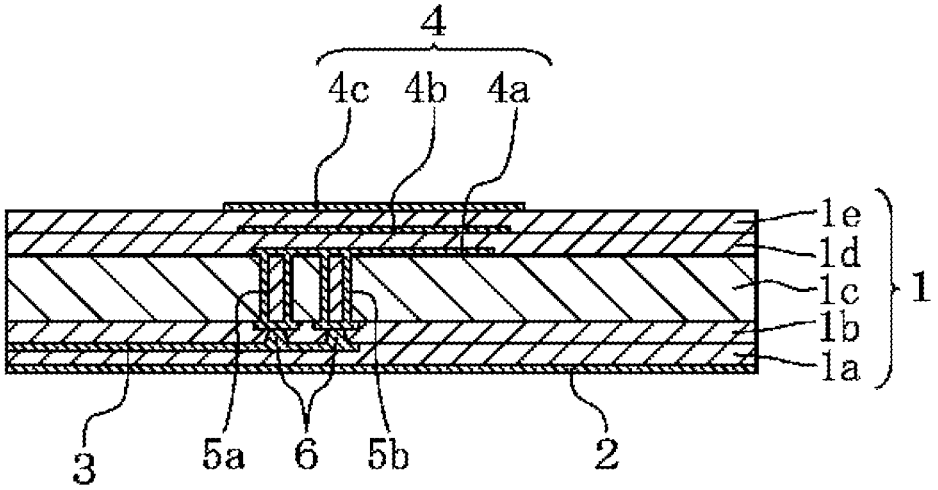
FIGS. 1A and 1B are a cross-sectional view and a top view, respectively, showing an antenna board according to a first preferred embodiment of the present invention.

Next, a first preferred embodiment of an antenna board according to the present invention will be described based on FIGS. 1A, 1B and 2. This antenna board includes a dielectric board 1 in which a plurality of dielectric layers 1*a* to 1*e* are laminated, a ground conductor layer 2 for shielding, a strip conductor 3 for inputting and outputting high-frequency signals, and a patch conductor 4 for transmitting and receiving electromagnetic waves as indicated by a cross-sectional view and a top view shown in FIGS. 1A and 1B, respectively, and an exploded perspective view shown in FIG. 2.

The dielectric layers 1*a* to 1*e* include, for example, a dielectric material of a resin having the glass cloth impregnated with a thermosetting resin such as an epoxy resin, a bismaleimide triazine resin, and an allyl modified polyphenylene ether resin. Each of the dielectric layers 1*a* to 1*e* has the thickness of about 30 to 100 μm. The dielectric layers 1*a* to 1*e* have the dielectric constants of about 3 to 5. The dielectric layers 1*a* to 1*e* include a first dielectric layer 1*a*, an intermediate dielectric layer 1*b*, a second dielectric layer 1*c*, a third dielectric layer 1*d*, and a fourth dielectric layer 1*e*, respectively.

The ground conductor 2 is deposited on the entire bottom surface of the first dielectric layer 1*a* formed on the bottom layer. The ground conductor 2 functions as a shielding. The ground conductor 2 has the thickness of about 5 to 20 μm. The ground conductor 2 includes, for example, copper.

The strip conductor 3 is opposed to the ground conductor 2 across the first dielectric layer 1*a*, and is disposed between the first dielectric layer 1*a* and the intermediate dielectric layer 1*b*. The strip conductor 3 is a narrow strip-shaped conductor including an end part 3*a* in the central part of the dielectric board 1, and extends in one direction (hereinafter referred to as "extending direction") to the end part 3*a* in the inner part of the dielectric board 1. The strip conductor 3 functions as a transmission line for inputting and outputting a high-frequency signal in the antenna board of the present invention, and a high-frequency signal is transmitted to the strip conductor 3. The strip conductor 3 has the width of about 50 to 350 μm. The strip conductor 3 has the thickness of about 5 to 20 μm. The strip conductor 3 includes, for example, copper.

The patch conductor 4 includes a first patch conductor 4*a*, a second patch conductor 4*b*, and a third patch conductor 4*c*. These patch conductors 4*a* to 4*c* are electrically independent of each other. The patch conductors 4*a* to 4*c* include quadrangle shapes having the sides parallel to the extending direction of the strip conductor 3 (hereinafter referred to as "longitudinal side") and the sides parallel to a direction perpendicular to the extending direction (hereinafter referred to as "lateral side"). Each side of the patch conductors 4*a* to 4*c* has the length of about 0.5 to 5 mm. Each of the patch conductors 4*a* to 4*c* has the thickness of about 5 to 20 μm. Each of the patch conductors 4*a* to 4*c* includes, for example, copper.

The first patch conductor 4*a* is disposed between the second dielectric layer 1*c* and the third dielectric layer 1*d* so as to cover the position of the end part 3*a* of the strip conductor 3. Therefore, between the first patch conductor 4*a* and the strip conductor 3, two layers of the dielectric layers 1*b* and 1*c* are interposed.

The first patch conductor 4*a* is connected to the end part 3*a* of the strip conductor 3 via penetration conductors 5*a* and 5*b* penetrating the second dielectric layer 1*c* and penetration conductors 6 penetrating the intermediate dielectric layer 1*b*. The two penetration conductors 5*a* and 5*b* are disposed and aligned adjacent to each other in the extending direction of the strip conductors 3, and have a columnar shape with the diameter of about 30 to 200 μm, or a cylindrical shape with the thickness of about 5 to 20 μm and the diameter of about 30 to 200 μm. The center-to-center distance of the two penetration conductors 5*a* and 5*b* is about 50 to 300 μm. The penetration conductors 6 have a columnar shape or a truncated cone shape with the diameter of about 30 to 100 μm. Each of the penetration conductors 5*a*, 5*b*, and 6 includes, for example, copper. In addition, the first patch conductor 4*a* radiates an electromagnetic wave to the outside by receiving the supply of a high-frequency signal from the strip conductor 3. Alternatively, the first patch conductor 4*a* leads the strip conductor 3 to generate a high-frequency signal by receiving an electromagnetic wave from the outside.

The second patch conductor 4*b* is disposed between the third dielectric layer 1*d* and the fourth dielectric layer 1*e* so as to cover the position where the first patch conductor 4*a* is formed. Thereby, the second patch conductor 4*b* is capacitively coupled with the first patch conductor 4*a* across the third dielectric layer 1*d*. By receiving an electromagnetic wave from the first patch conductor 4*a*, the second patch conductor 4*b* radiates to the outside an electromagnetic wave corresponding to the received electromagnetic wave. Alternatively, by receiving an electromagnetic wave from the outside, the second patch conductor 4*b* supplies the first patch conductor 4*a* with an electromagnetic wave corresponding to the received electromagnetic wave. Each side of the second patch conductor 4*b* is preferred to be equal to or larger than the corresponding side of the first patch conductor 4*a* by about up to 0.5 mm.

The third patch conductor 4*c* is disposed on a top surface of the fourth dielectric layer 1*e* of the uppermost layer so as to cover the position where the second patch conductor 4*b* is formed. Thereby, the third patch conductor 4*c* is capacitively coupled with the second patch conductor 4*b* across the fourth dielectric layer 1*e*. By receiving an electromagnetic wave from the second patch conductor 4*b*, the third patch conductor 4*c* radiates to the outside an electromagnetic wave corresponding to the received electromagnetic wave. Alternatively, by receiving an electromagnetic wave from the outside, the third patch conductor 4*c* supplies the second patch conductor 4*b* with an electromagnetic wave corresponding to the received electromagnetic wave. Each side of the third patch conductor 4*c* is preferred to be equal to or larger than the corresponding side of the second patch conductor 4*b* by about up to 0.5 mm.

In the antenna board of the present invention, it is important that the two penetration conductors 5*a* and 5*b* connecting the strip conductors 3 and the first patch conductor 4*a* are disposed and aligned adjacent to each other in the extending direction of the strip conductor 3. By the two penetration conductors 5*a* and 5*b* disposed in this manner, a complex resonance in the first to third patch conductors occurs satisfactorily. Therefore, it is possible to provide a broadband antenna board capable of transmitting and receiving a satisfactory signal in a wide frequency band.

Figure 1B:
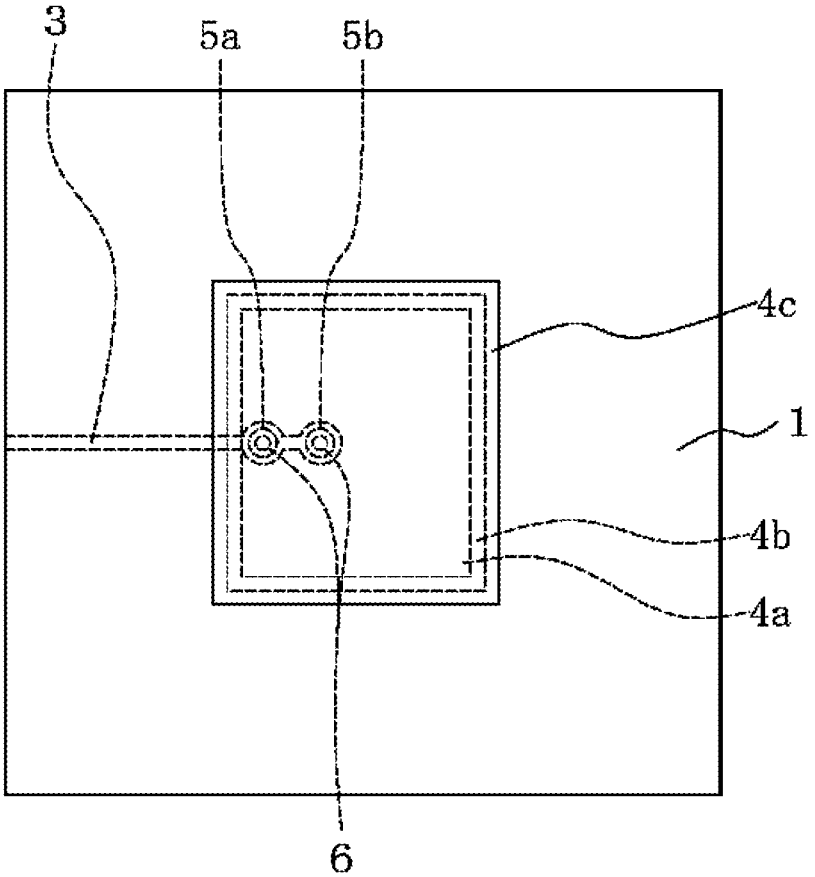
Figure 2:
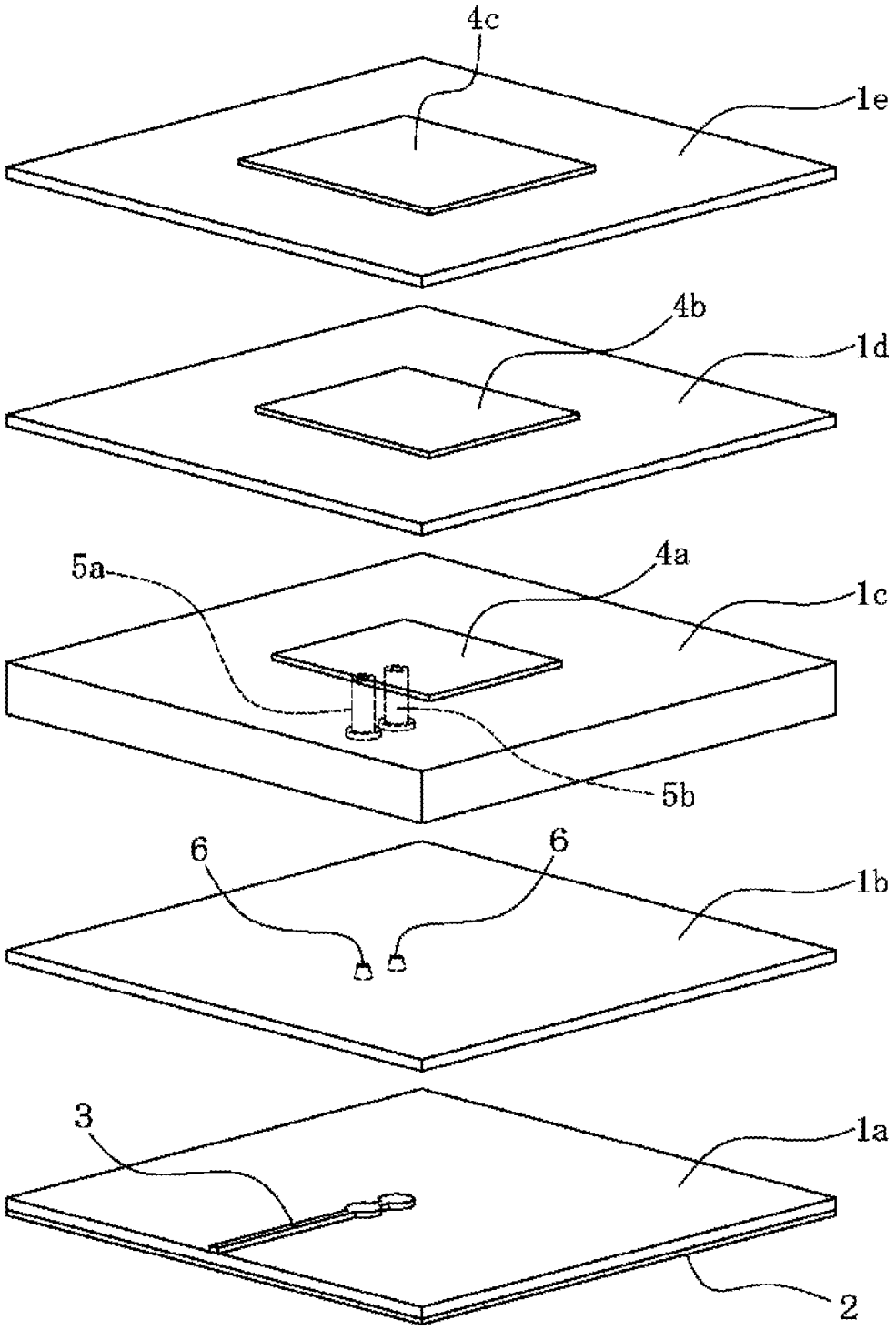
FIG. 2 is an exploded perspective view of the antenna board shown in FIGS. 1A and 1B.
Figure 3:
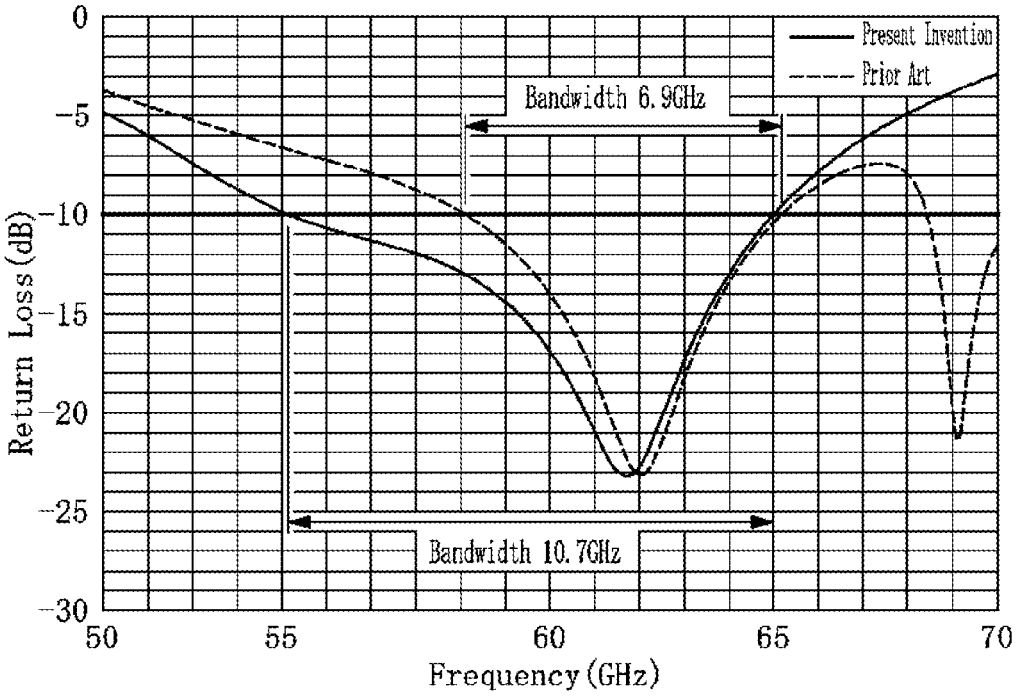
FIG. 3 is a graph showing a result of a simulation of return losses of a signal by using an analysis model by the antenna board of the present invention shown in FIGS. 1A and 1B and an analysis model by a conventional antenna board shown in FIGS. 14A and 14B.
Figure 14A:
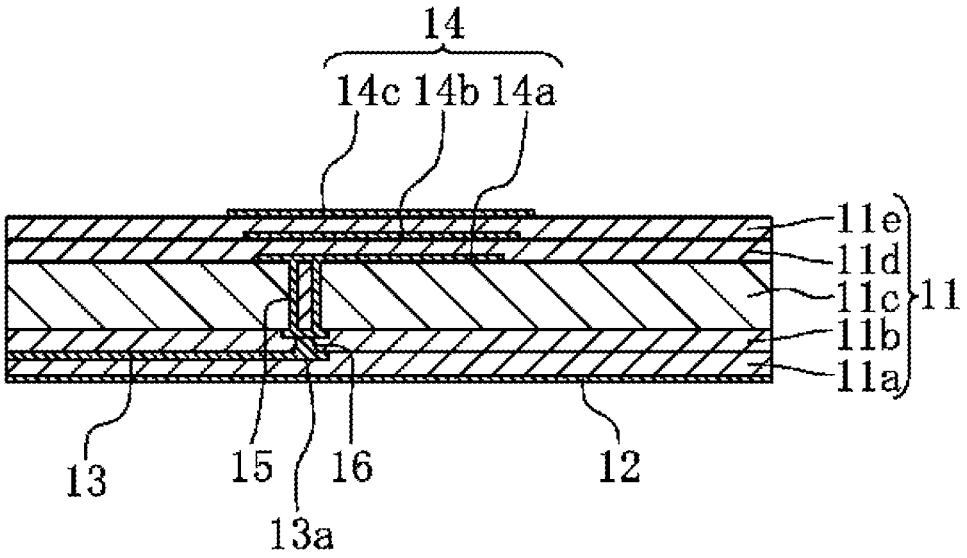
Fig. 14A PRIOR ART
FIGS. 14A and 14B are a cross-sectional view and a top view, respectively, showing a conventional antenna board.
Figure 14B:
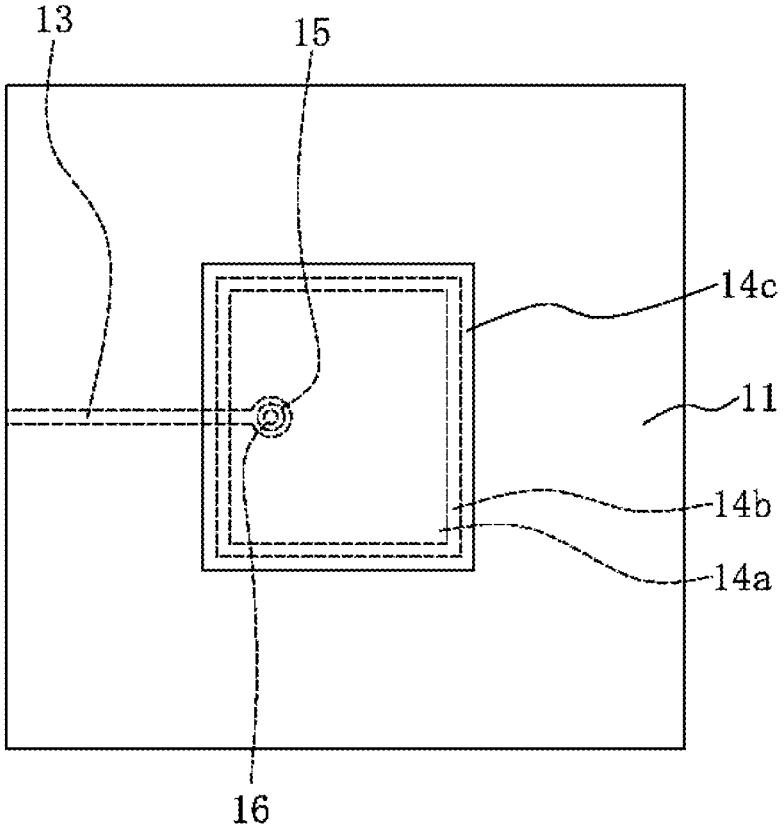
Fig. 14B PRIOR ART
Figure 15:
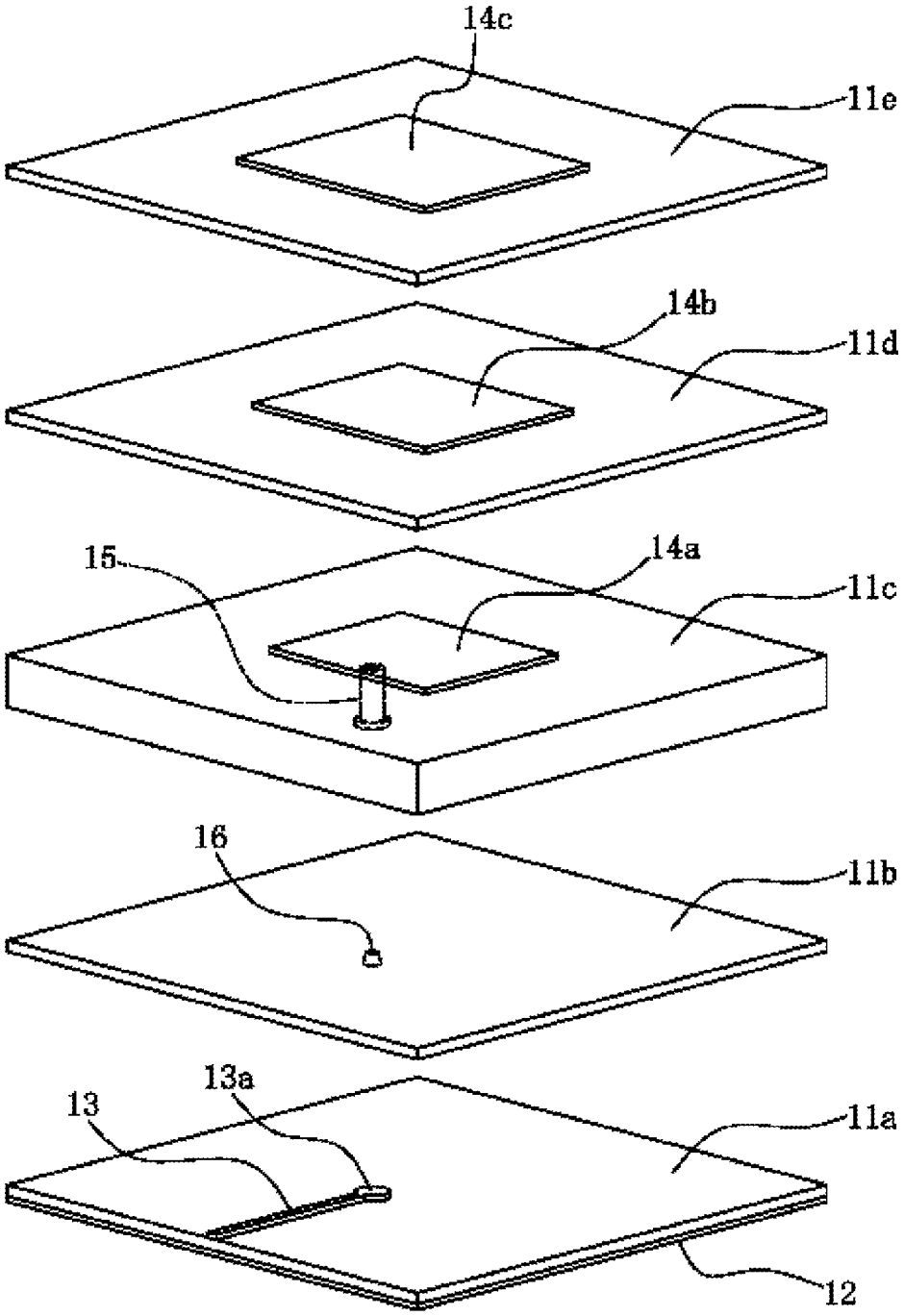
Fig. 15 PRIOR ART
FIG. 15 is an exploded perspective view of the antenna board shown in FIGS. 14A and 14B.

In analysis models where the antenna board of the first preferred embodiment shown in FIGS. 1A and 1B and the conventional antenna board shown in FIGS. 14A and 14B were modeled, the return losses were simulated by an electromagnetic field simulator when a high-frequency signal was input into a strip conductor. The results are shown in FIG. 3. In FIG. 3, the graph indicated by the solid line is the return loss of the analysis model by the antenna board of the first preferred embodiment, and the graph shown by the broken line is the return loss of the analysis model by the conventional antenna board. In FIG. 3, the frequency bandwidth of the return loss of −10 dB, which is indicated by the thick graduation mark, or less is required to be as wide as possible. As is apparent in FIG. 3, in the analysis model by the conventional antenna board, the frequency bandwidth of the return loss of −10 dB or less which is required by an antenna board is a narrow bandwidth of about 6.9 GHz. In contrast, in the analysis model by the antenna board of the first preferred embodiment, the frequency bandwidth of the return loss of −10 dB or less is found to be a broad bandwidth of about 10.7 GHz.

The simulation conditions were as follows. In the analysis model by the antenna board of the first preferred embodiment, each of the dielectric layers 1*a* to 1*e* shown in FIGS. 1A and 1B had the dielectric constant of 3.35. Each of the dielectric layers 1*a*, 1*b*, 1*d* and 1*e* had the thickness of 50 μm, and the dielectric layer 1*c* had the thickness of 100 μm. The strip conductor 3, the ground conductor layer 2 and the patch conductors 4*a* to 4*c* were formed by copper, and each of them had the thickness of 18 μm. The strip conductor 3 had the width of 85 μm and the length of 3 mm, and was disposed so as to extend in one direction from the outer peripheral edge to the central part of the dielectric board 1 between the dielectric layers 1*a* and 1*b*, and so that the end part 3*a* was positioned in the central part of the dielectric board 1. In the end part 3*a* of the strip conductor 3, two circular land patterns of 180 μm in diameter were disposed at the center-to-center distance of 200 μm.

As for the first patch conductor 4*a*, the longitudinal side parallel to the extending direction of the strip conductor 3 had the length of 1 mm, and the lateral side perpendicular to this had the length of 1.4 mm. The first patch conductor 4*a* and the land pattern disposed on the end part 3*a* of the strip conductor 3 were connected by the penetration conductors 5*a* and 5*b* having columnar shapes of 90 μm in diameter and the penetration conductors 6 having columnar shapes of 90 μm in diameter. The connection positions of the penetration conductors 5*a* and 5*b* were respectively the positions, where the centers of the penetration conductors 5*a* and 5*b* were disposed, at 50 μm and 200 μm from the lateral side on the side to which the strip conductor 3 extended in the center between the two longitudinal sides of the first patch conductor 4*a*. The penetration conductors 5*a*, 5*b*, and 6 were formed by copper.

As for the second patch conductor 4*b*, the longitudinal side parallel to the extending direction of the strip conductor 3 had the length of 1 mm, and the lateral side perpendicular to this had the length of 1.5 mm. The second patch conductor 4*b* was disposed so that the position of its center overlaps the position of the center of the first patch electrode 4*a*.

As for the third patch conductor 4*c*, the longitudinal side parallel to the extending direction of the strip conductor 3 had the length of 1.2 mm, and the lateral side perpendicular to this had the length of 1.6 mm. The third patch conductor 4*c* was disposed so that the position of its center overlaps the position of the center of the first patch conductor 4*a* and the position of the center of the second patch conductor 4*b*.

As for the analysis model by the conventional antenna board, a model was used which was entirely identical with the analysis model by the antenna board of the first preferred embodiment except that only one land pattern was disposed at the end part 3*a* of the strip conductor 3, and that only the penetration conductor 5*a* and the penetration conductor 6 to be connected to this was disposed.

Next, the second preferred embodiment of an antenna board according to the present invention will be described with reference to FIGS. 4A and 4B. It should be noted that in the antenna board of the second preferred embodiment, the portions common to the antenna board of the first preferred embodiment are denoted by the same reference characters of the antenna board of the first preferred embodiment, and that its detailed description will be omitted.

Compared with the antenna board of the first preferred embodiment, in the antenna board of the second preferred embodiment, there are differences in that the center of the second patch conductor 4*b* is deviated with respect to the center of the first patch conductor 4*a* in the extending direction of the strip conductor 3, and that the center of the third patch conductor 4*c* is deviated with respect to the center of the second patch conductor 4*b* in the extending direction of the strip conductors 3. The deviation of the second patch conductor 4*b* is set to the extent that it covers 80% or more of the area of the position where the first patch conductor 4*a* is formed. The deviation of the third patch conductor 4*c* is set to the extent that it covers 80% or more of the area of the position where the second patch conductor 4*b* is formed. The rest are the same as those of the antenna board of the first preferred embodiment. When the patch conductor is a quadrangle, the center of the patch conductor refers to the intersection of the two diagonals.

According to the antenna board of the second preferred embodiment, the first patch conductor 4*a*, the second patch conductor 4*b*, and the third patch conductor 4*c* are disposed to be deviated from each other in the extending direction of the strip conductors 3. Thus, a more complex resonance occurs satisfactorily in the first to third patch conductors 4*a* to 4*c* disposed in this manner. Therefore, it is possible to provide a broadband antenna board that can transmit and receive a satisfactory signal in a wide frequency band.

Figure 4A:
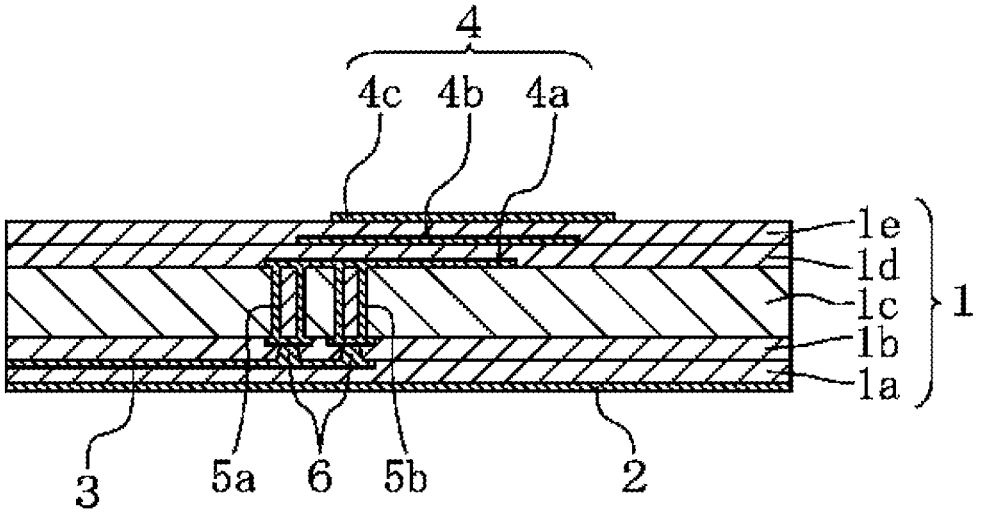
FIGS. 4A and 4B are a cross-sectional view and a top view, respectively, showing an antenna board according to a second preferred embodiment of the present invention.
Figure 4B:
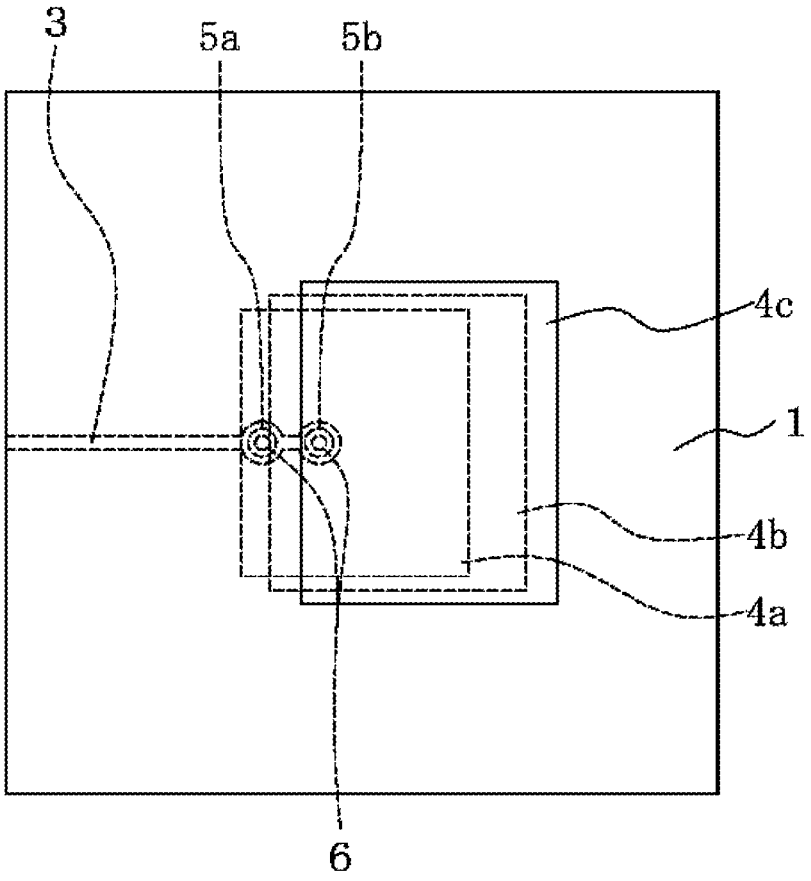
Figure 5:
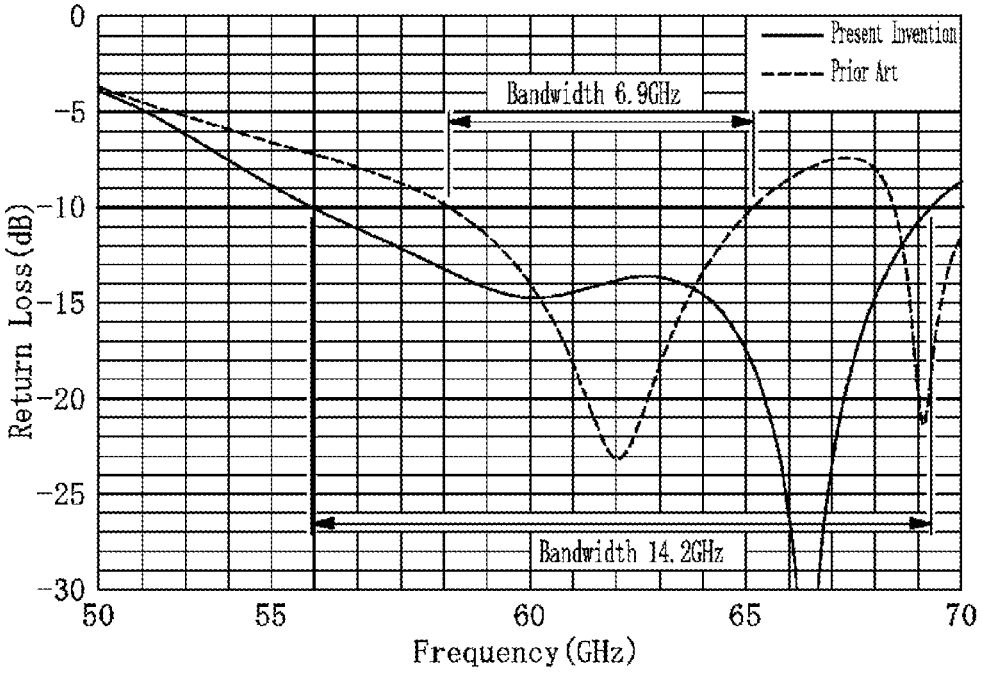
FIG. 5 is a graph showing a result of a simulation of return losses of a signal by using an analysis model by the antenna board of the present invention shown in FIGS. 4A and 4B and an analysis model by the conventional antenna board shown in FIGS. 14A and 14B.

In analysis models where the antenna board of the second preferred embodiment shown in FIGS. 4A and 4B and the conventional antenna board shown in FIGS. 14A and 14B were modeled, the return losses were simulated by an electromagnetic field simulator when a high-frequency signal was input into a strip conductor. The results are shown in FIG. 5. In FIG. 5, the graph indicated by the solid line is the return loss of the analysis model by the antenna board of the second preferred embodiment, and the graph shown by the broken line is the return loss of the analysis model by the conventional antenna board. In FIG. 5, the frequency bandwidth of the return loss of −10 dB, which is indicated by the thick graduation mark, or less is required to be as wide as possible. As is apparent in FIG. 5, in the analysis model by the conventional antenna board, the frequency bandwidth of the return loss of −10 dB or less which is required by an antenna board is a narrow bandwidth of about 6.9 GHz. In contrast, in the analysis model by the antenna board of the second preferred embodiment, the frequency bandwidth of the return loss of −10 dB or less is found to be a broad bandwidth of about 14.2 GHz.

As for the analysis model by the antenna board of the second preferred embodiment, compared with the analysis model by the antenna board of the first preferred embodiment, a model was used which was entirely identical with the analysis model by the antenna board of the first preferred embodiment except that the position of the second patch conductor 4*b* and the position of the third patch conductor 4*c* were different. The center position of the second patch conductor 4*b* was disposed to be deviated from the center position of the first patch conductor 4*a* in the extending direction of the strip line 3 so that the second patch conductor 4*b* covered the 90% of the area of the position where the first patch conductor 4*a* was formed. The center position of the third patch conductor 4*c* was disposed to be deviated from the center position of the second patch conductor 4*b* in the extending direction of the strip line 3 so that the third patch conductor 4*c* covered the 90% of the area of the position where the second patch conductor 4*b* was formed.

Next, a third preferred embodiment of an antenna board according to the present invention will be described with reference to FIGS. 6A and 6B. It should be noted that in the antenna board of the third preferred embodiment, the portions common to the antenna board of the first preferred embodiment are denoted by the same reference characters of the antenna board of the first preferred embodiment, and that its detailed description will be omitted.

Compared with the antenna board of the first preferred embodiment, in the antenna board of the third preferred embodiment, there is a difference in that auxiliary patch conductors 7 are disposed on the top surface of the fourth dielectric layer 1*e* located on the uppermost layer. The auxiliary patch conductors 7 are disposed one by one at intervals of about 0.1 to 1 mm from the third patch conductor 4*c* on each side of the third patch conductor 4*c* in the direction orthogonal to the extending direction of the strip conductors 3. The auxiliary patch conductors 7 have a quadrangle shape having the longitudinal sides parallel to the longitudinal sides of the third patch conductor 4*c*, the lateral sides parallel to the lateral sides of the third patch conductor 4*c*, and each one side with the length of about 0.1 to 5 mm. The auxiliary patch conductors 7 are disposed so as not to cover the positions where the first patch conductor 4*a* and the second patch conductor 4*b* are formed. The auxiliary patch conductors 7 include, for example, copper in the same manner as the patch conductors 4. The rest are the same as those of the antenna board of the first preferred embodiment.

According to the antenna board of the third preferred embodiment, the antenna board includes the auxiliary patch conductor 7 disposed on each side of the third patch conductor 4*c* in the direction orthogonal to the extending direction of the strip conductors 3 so that the auxiliary patch conductors 7 do not cover the positions where the first patch conductor 4*a* and the second patch conductor 4*b* are formed. Thus, a more complex resonance occurs satisfactorily in the first to third patch conductors 4*a* to 4*c* and the auxiliary patch conductors 7 disposed in this manner. Therefore, it is possible to provide a broadband antenna board that can transmit and receive a satisfactory signal in a wide frequency band.

Figure 6A:
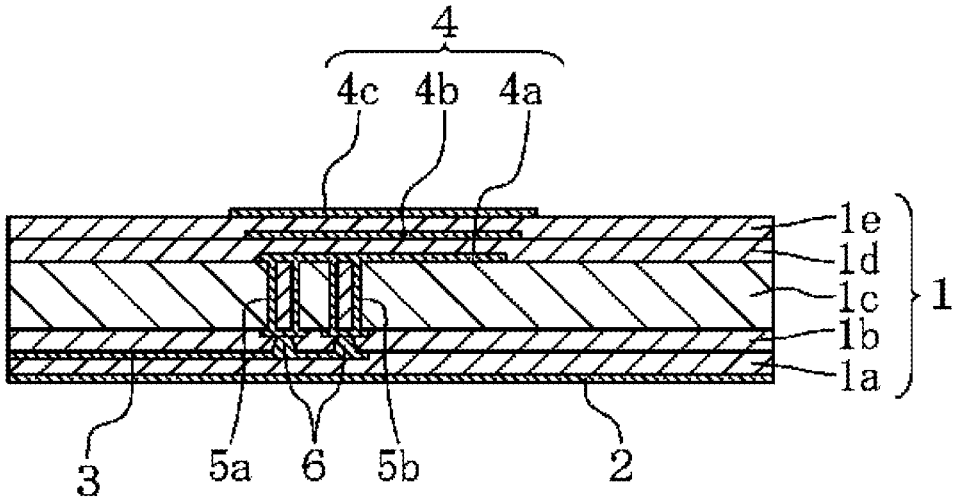
FIGS. 6A and 6B are a cross-sectional view and a top view, respectively, showing an antenna board according to a third preferred embodiment of the present invention.
Figure 6B:
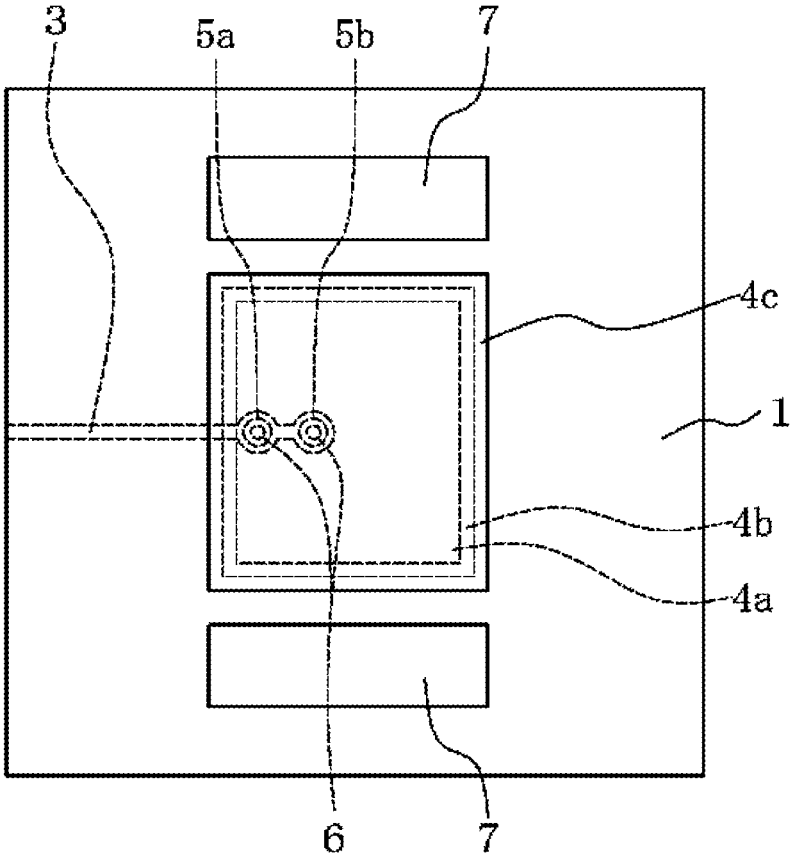
Figure 7:
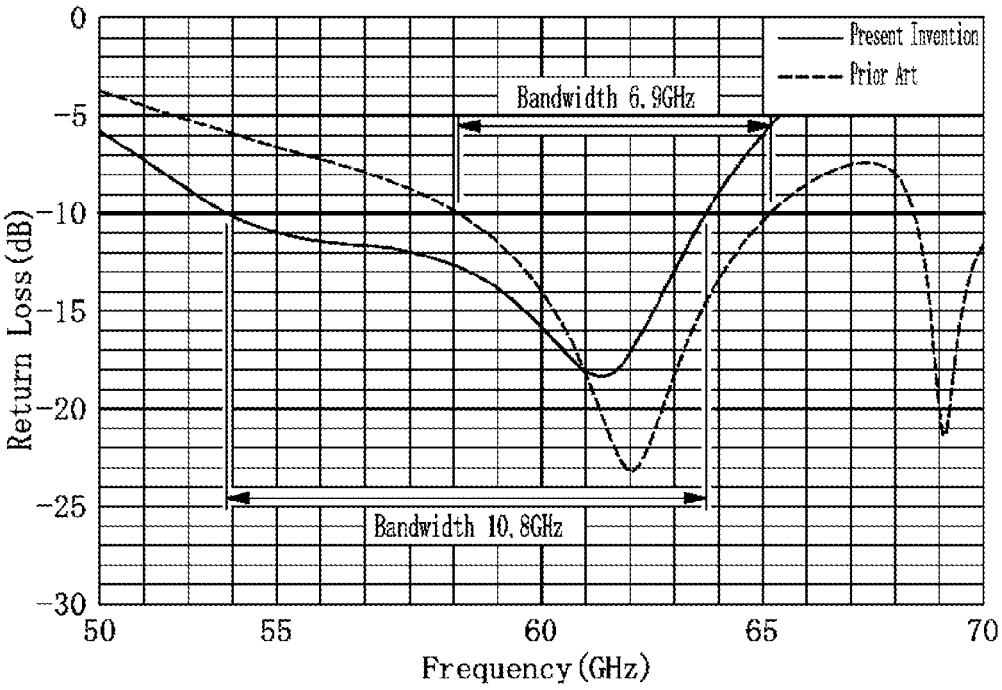
FIG. 7 is a graph showing a result of a simulation of return losses of a signal by using an analysis model by the antenna board of the present invention shown in FIGS. 6A and 6B and an analysis model by the conventional antenna board shown in FIGS. 14A and 14B.

In analysis models where the antenna board of the third preferred embodiment shown in FIGS. 6A and 6B and the conventional antenna board shown in FIGS. 14A and 14B were modeled, the return losses were simulated by an electromagnetic field simulator when a high-frequency signal was input into a strip conductor. The results are shown in FIG. 7. In FIG. 7, the graph indicated by the solid line is the return loss of the analysis model by the antenna board of the third preferred embodiment, and the graph shown by the broken line is the return loss of the analysis model by the conventional antenna board. In FIG. 7, the frequency bandwidth of the return loss of −10 dB, which is indicated by the thick graduation mark, or less is required to be as wide as possible. As is apparent in FIG. 7, in the analysis model by the conventional antenna board, the frequency bandwidth of the return loss of −10 dB or less which is required by an antenna board is a narrow bandwidth of about 6.9 GHz. In contrast, in the analysis model by the antenna board of the third preferred embodiment, the frequency bandwidth of the return loss of −10 dB or less is found to be a broad bandwidth of about 10.8 GHz.

As for the analysis model by the antenna board of the third preferred embodiment, compared with the analysis model by the antenna board of the first preferred embodiment, a model was used which was entirely identical with the analysis model by the antenna board of the first preferred embodiment except that the auxiliary patch conductors 7 were disposed. The auxiliary patch conductor 7 was formed of copper, which had the longitudinal side parallel to the extending direction of the strip conductor 3 with the length of 1.1 mm, and the lateral side perpendicular to this with the length of 0.5 mm. The auxiliary patch conductors 7 were disposed one by one on each side of the third patch conductor 4*c* in the longer side direction by the longitudinal sides being aligned right beside the longitudinal sides of the third patch conductor 4*c*. The distance between the third patch conductor 4*c* and auxiliary patch conductor 7 was 0.35 mm.

Next, a fourth preferred embodiment of an antenna board according to the present invention will be described with reference to FIGS. 8A and 8B. It should be noted that in the antenna board of the fourth preferred embodiment, the portions common to the antenna board of the second preferred embodiment are denoted by the same reference characters of the antenna board of the second preferred embodiment, and that its detailed description will be omitted.

Compared with the antenna board of the second preferred embodiment, in the antenna board of the fourth preferred embodiment, there is a difference in that auxiliary patch conductors 7 are disposed on the top surface of the fourth dielectric layer 1*e* located on the uppermost layer. The details of the auxiliary patch conductors 7 are as described above, and the description will be omitted. The rest are the same as those of the antenna board of the second preferred embodiment.

According to the antenna board of the fourth preferred embodiment, the first patch conductor 4*a*, the second patch conductor 4*b*, and the third patch conductor 4*c* are disposed to be deviated from each other in the extending direction of the strip conductors 3, and the antenna board includes the auxiliary patch conductor 7 on each side of the third patch conductor 4*c* in a direction orthogonal to the extending direction of the strip conductors 3 so as not to cover the positions where the first patch conductor 4*a* and the second patch conductor 4*b* are formed. Thus, a more complex resonance occurs satisfactorily in the first to third patch conductors 4*a* to 4*c* and the auxiliary patch conductors 7 disposed in this manner. Therefore, it is possible to provide a broadband antenna board that can transmit and receive a satisfactory signal in a wide frequency band.

Figure 8A:
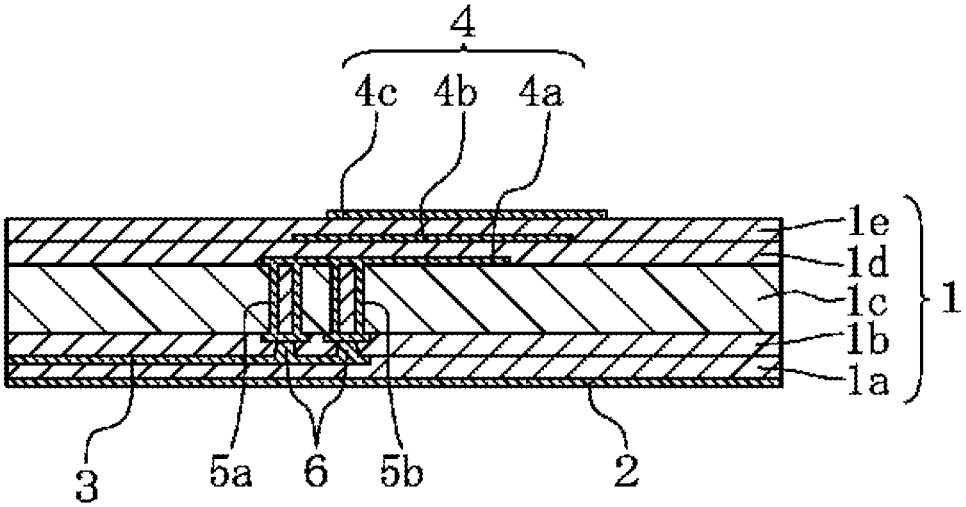
FIGS. 8A and 8B are a cross-sectional view and a top view, respectively, showing an antenna board according to a fourth preferred embodiment of the present invention.
Figure 8B:
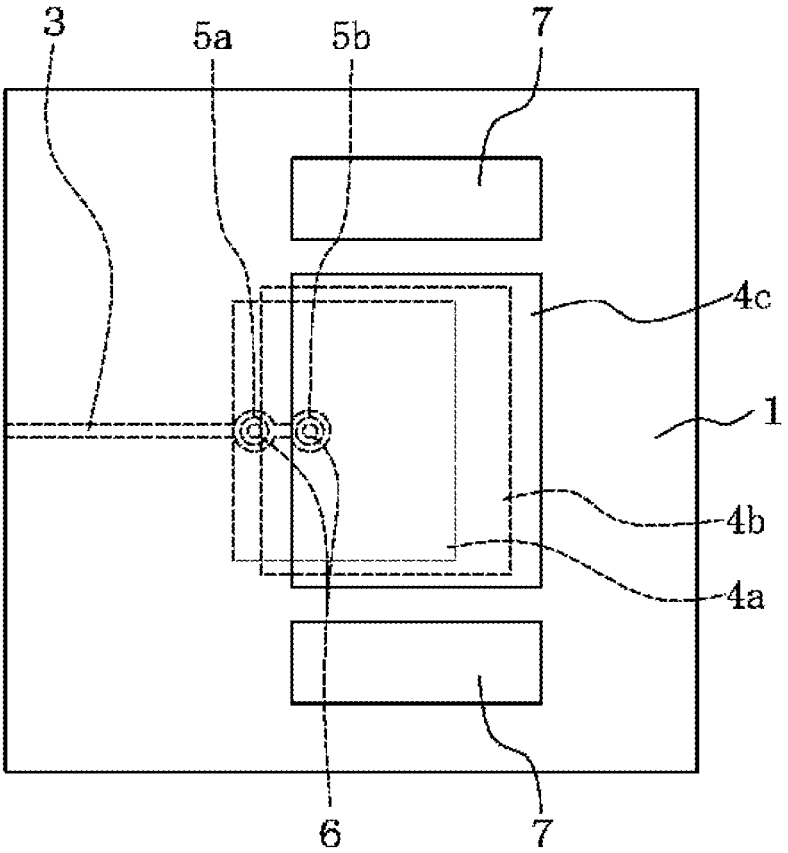
Figure 9:
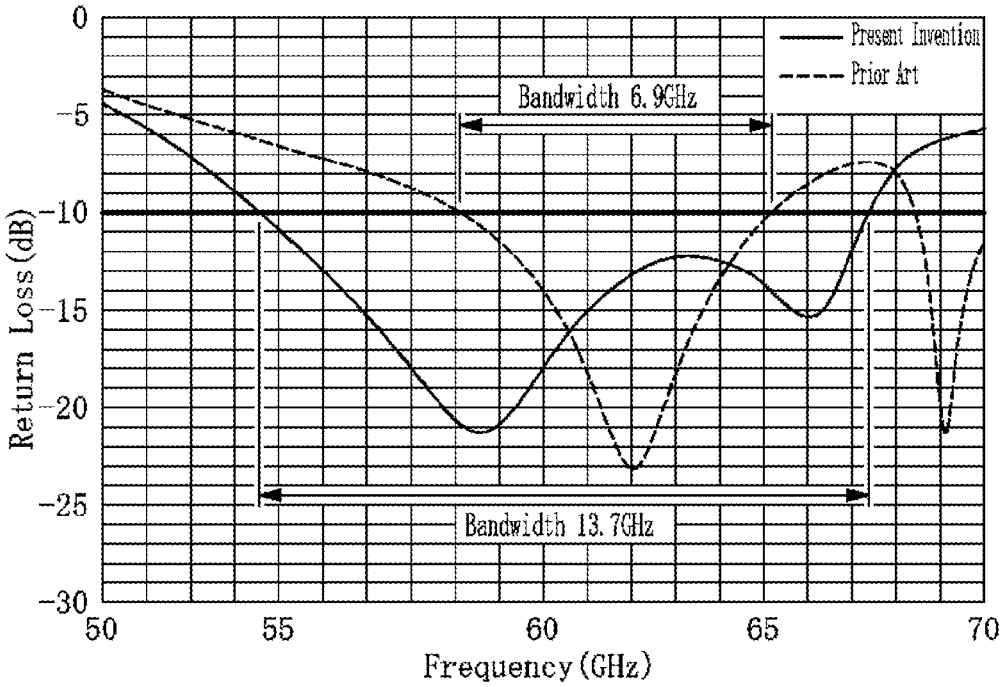
FIG. 9 is a graph showing a result of a simulation of return losses of a signal by using an analysis model by the antenna board of the present invention shown in FIGS. 8A and 8B and an analysis model by the conventional antenna board shown in FIGS. 14A and 14B.

In analysis models where the antenna board of the fourth preferred embodiment shown in FIGS. 8A and 8B and the conventional antenna board shown in FIGS. 14A and 14B were modeled, the return losses were simulated by an electromagnetic field simulator when a high-frequency signal was input into a strip conductor. The results are shown in FIG. 9. In FIG. 9, the graph indicated by the solid line is the return loss of the analysis model by the antenna board of the fourth preferred embodiment, and the graph shown by the broken line is the return loss of the analysis model by the conventional antenna board. In FIG. 9, the frequency bandwidth of the return loss of −10 dB, which is indicated by the thick graduation mark, or less is required to be as wide as possible. As is apparent in FIG. 9, in the analysis model by the conventional antenna board, the frequency bandwidth of the return loss of −10 dB or less which is required by an antenna board is a narrow bandwidth of about 6.9 GHz. In contrast, in the analysis model by the antenna board of the fourth preferred embodiment, the frequency bandwidth of the return loss of −10 dB or less is found to be a broad bandwidth of about 13.7 GHz.

As for the analysis model by the antenna board of the fourth preferred embodiment, compared with the analysis model by the antenna board of the second preferred embodiment, a model was used which was entirely identical with the analysis model by the antenna board of the second preferred embodiment except that the auxiliary patch conductors 7 were disposed. The auxiliary patch conductor 7 was formed of copper, which had the longitudinal side parallel to the extending direction of the strip conductor 3 with the length of 1.1 mm, and the lateral side perpendicular to this with the length of 0.5 mm. The auxiliary patch conductors 7 were disposed one by one on each side of the third patch conductor 4*c* in the longer side direction by the longitudinal sides being aligned right beside the longitudinal sides of the third patch conductor 4*c*. The distance between the third patch conductor 4*c* and auxiliary patch conductor 7 was 0.3 mm.

Next, a fifth preferred embodiment of an antenna board according to the present invention will be described with reference to FIGS. 10A and 10B. It should be noted that in the antenna board of the fifth preferred embodiment, the portions common to the antenna board of the third preferred embodiment are denoted by the same reference characters of the antenna board of the third preferred embodiment, and that its detailed description will be omitted.

Compared with the antenna board of the third preferred embodiment, in the antenna board of the fifth preferred embodiment, there is a difference in that the auxiliary patch conductors 7 are deviated in the extending direction of the strip conductors 3 with respect to the third patch conductor 4*c*. The auxiliary patch conductors 7 are deviated to the extent that about half of the longitudinal side protrudes in the extending direction of the strip conductor 3 from the third patch conductor 4*c*. The rest are the same as those of the antenna board of the third preferred embodiment.

According to the antenna board of the fifth preferred embodiment, the auxiliary patch conductors 7 are deviated in the extending direction of the strip conductor 3 with respect to the third patch conductor 4*c*. Thus, a more complex resonance occurs satisfactorily in the first to third patch conductors 4*a* to 4*c* and the auxiliary patch conductors 7 disposed in this manner. Therefore, it is possible to provide a broadband antenna board that can transmit and receive a satisfactory signal in a wide frequency band.

Figure 10A:
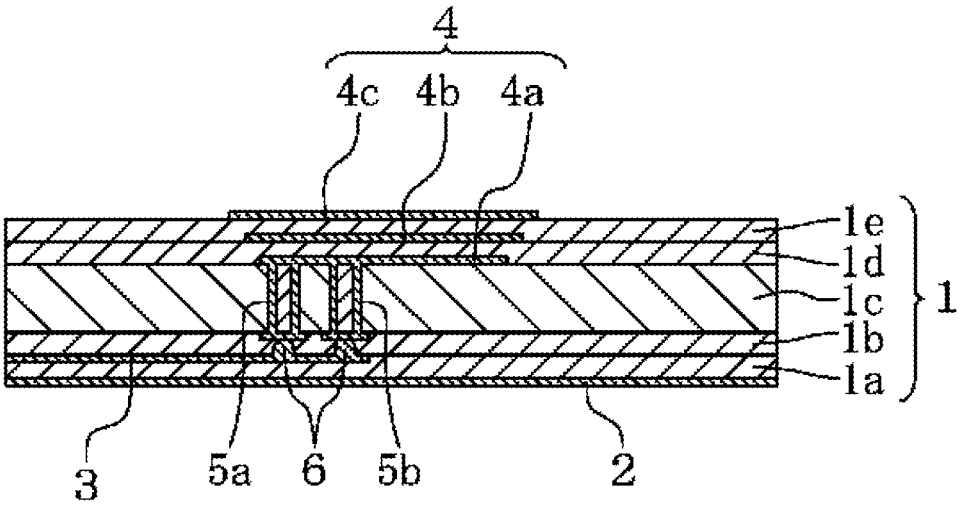
FIGS. 10A and 10B are a cross-sectional view and a top view, respectively, showing an antenna board according to a fifth preferred embodiment of the present invention.
Figure 10B:
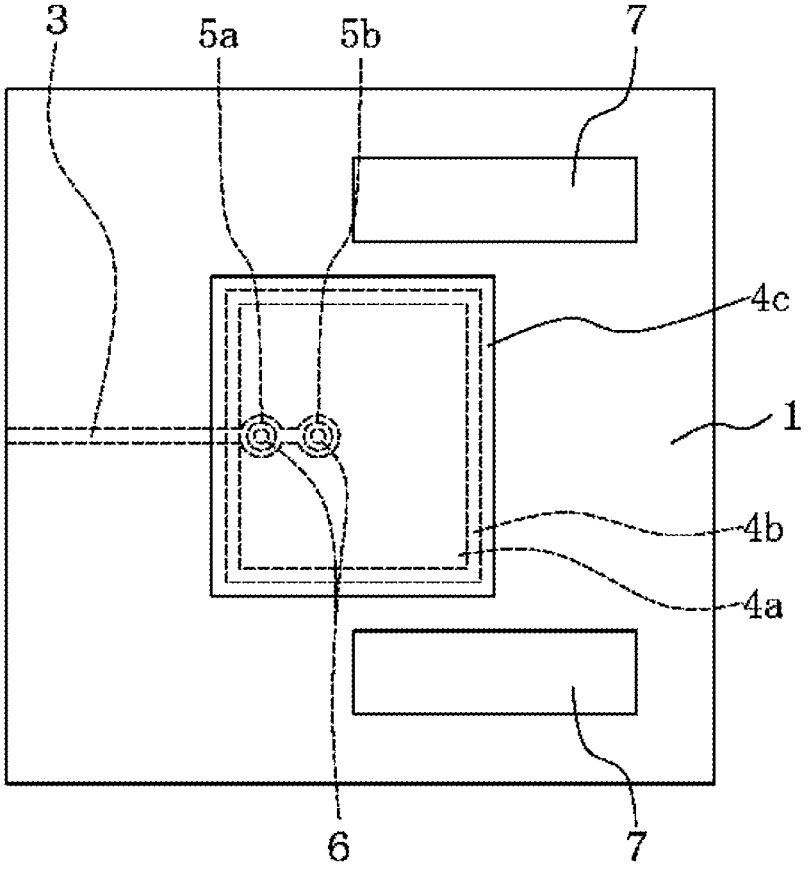
Figure 11:
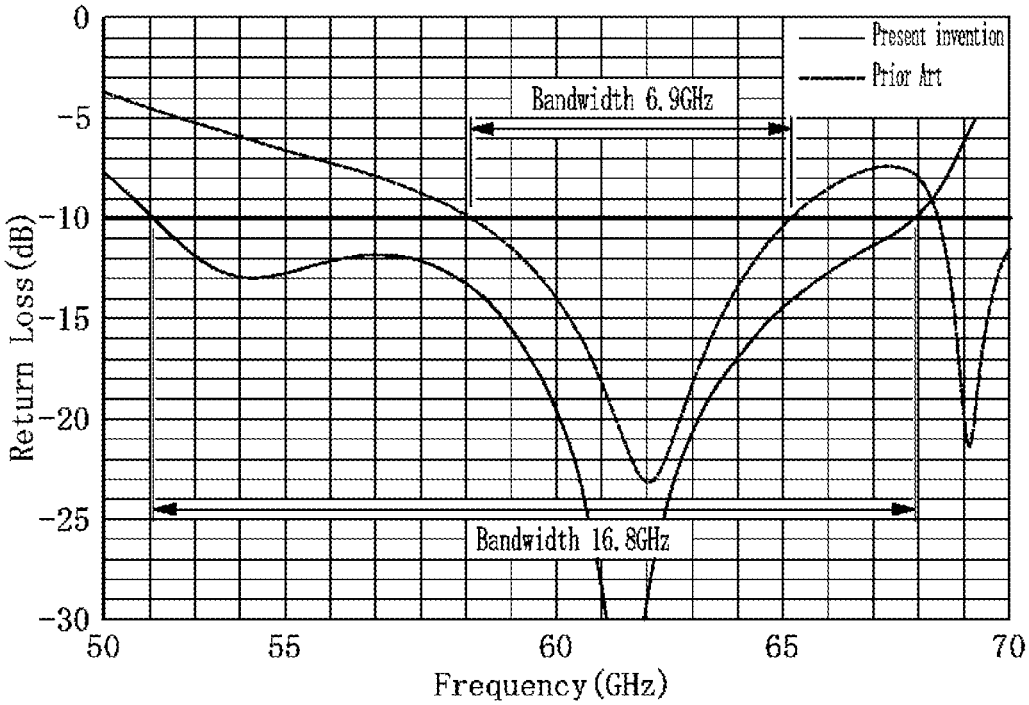
FIG. 11 is a graph showing a result of a simulation of return losses of a signal by using an analysis model by the antenna board of the present invention shown in FIGS. 10A and 10B and an analysis model by the conventional antenna board shown in FIGS. 14A and 14B.

In analysis models where the antenna board of the fifth preferred embodiment shown in FIGS. 10A and 105 and the conventional antenna board shown in FIGS. 14A and 14B were modeled, the return losses were simulated by an electromagnetic field simulator when a high-frequency signal was input into a strip conductor. The results are shown in FIG. 11. In FIG. 11, the graph indicated by the solid line is the return loss of the analysis model by the antenna board of the fifth preferred embodiment, and the graph shown by the broken line is the return loss of the analysis model by the conventional antenna board. In FIG. 11, the frequency bandwidth of the return loss of −10 dB, which is indicated by the thick graduation mark, or less is required to be as wide as possible. As is apparent in FIG. 11, in the analysis model by the conventional antenna board, the frequency bandwidth of the return loss of −10 dB or less which is required by an antenna board is a narrow bandwidth of about 6.9 GHz. In contrast, in the analysis model by the antenna board of the fifth preferred embodiment, the frequency bandwidth of the return loss of −10 dB or less is found to be a broad bandwidth of about 16.8 GHz.

As for the analysis model by the antenna board of the fifth preferred embodiment, compared with the analysis model by the antenna board of the third preferred embodiment, a model was used which was entirely identical with the analysis model by the antenna board of the third preferred embodiment except that the auxiliary patch conductors 7 were deviated to protrude 0.5 mm in the extending direction of the strip conductor 3 from the third patch conductor 4*c*.

Next, a sixth preferred embodiment of an antenna board according to the present invention will be described with reference to FIGS. 12A and 12B. It should be noted that in the antenna board of the sixth preferred embodiment, the portions common to the antenna board of the fourth preferred embodiment are denoted by the same reference characters of the antenna board of the fourth preferred embodiment, and that its detailed description will be omitted.

Compared with the antenna board of the fourth preferred embodiment, in the antenna board of the sixth preferred embodiment, there is a difference in that the auxiliary patch conductors 7 are deviated in the extending direction of the strip conductors 3 with respect to the third patch conductor 4*c*. The auxiliary patch conductors 7 are deviated to the extent that about half of the longitudinal side protrudes in the extending direction of the strip conductor 3 from the third patch conductor 4*c*. The rest are the same as those of the antenna board of the fourth preferred embodiment.

According to the antenna board of the sixth preferred embodiment, the auxiliary patch conductors 7 are deviated in the extending direction of the strip conductor 3 with respect to the third patch conductor 4*c*. Thus, more complex resonance occurs satisfactorily in the first to third patch conductors 4*a* to 4*c* and the auxiliary patch conductors 7 disposed in this manner. Therefore, it is possible to provide a broadband antenna board that can transmit and receive a satisfactory signal in a wide frequency band.

Figure 12A:
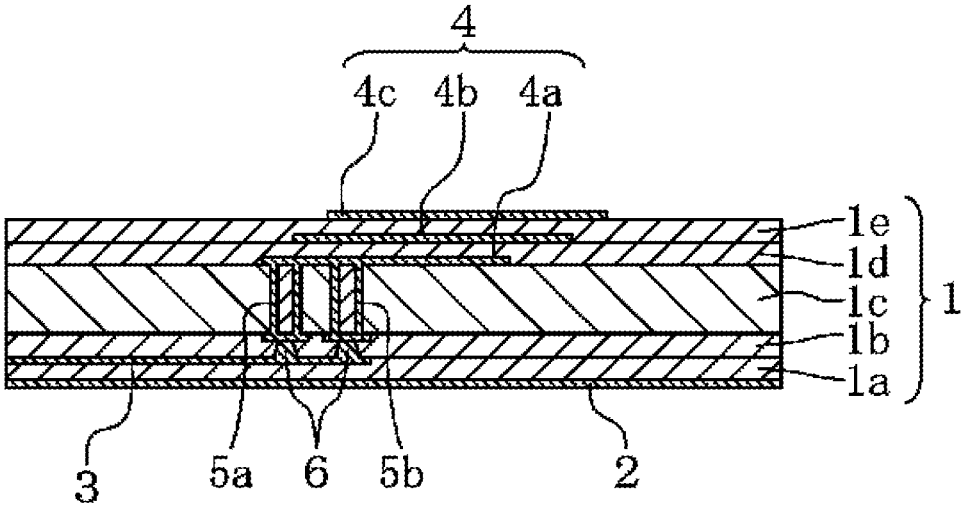
FIGS. 12A and 12B are a cross-sectional view and a top view, respectively, showing an antenna board according to a sixth preferred embodiment of the present invention.
Figure 12B:
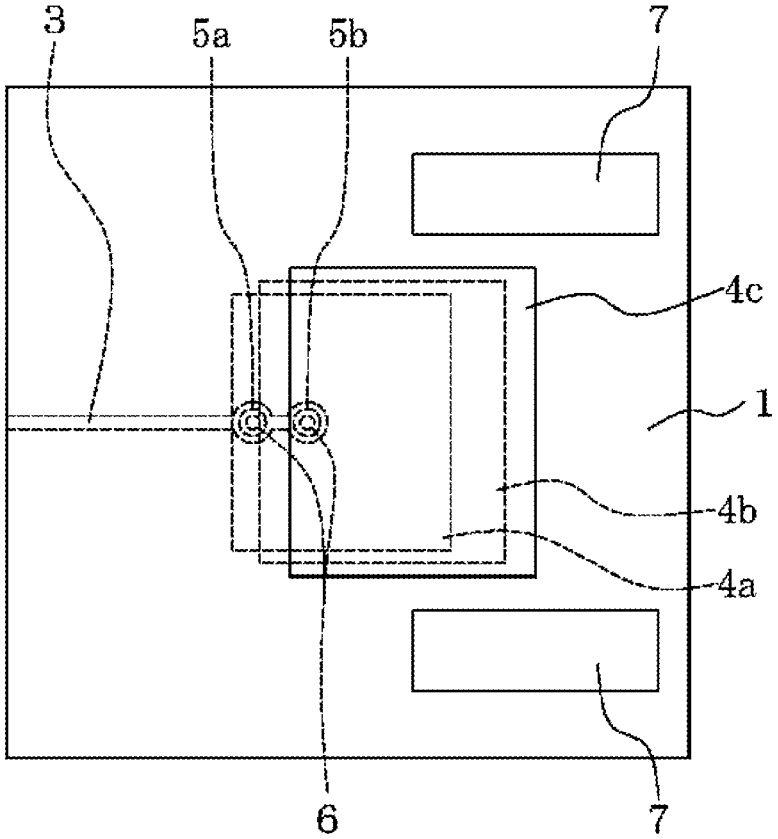
Figure 13:
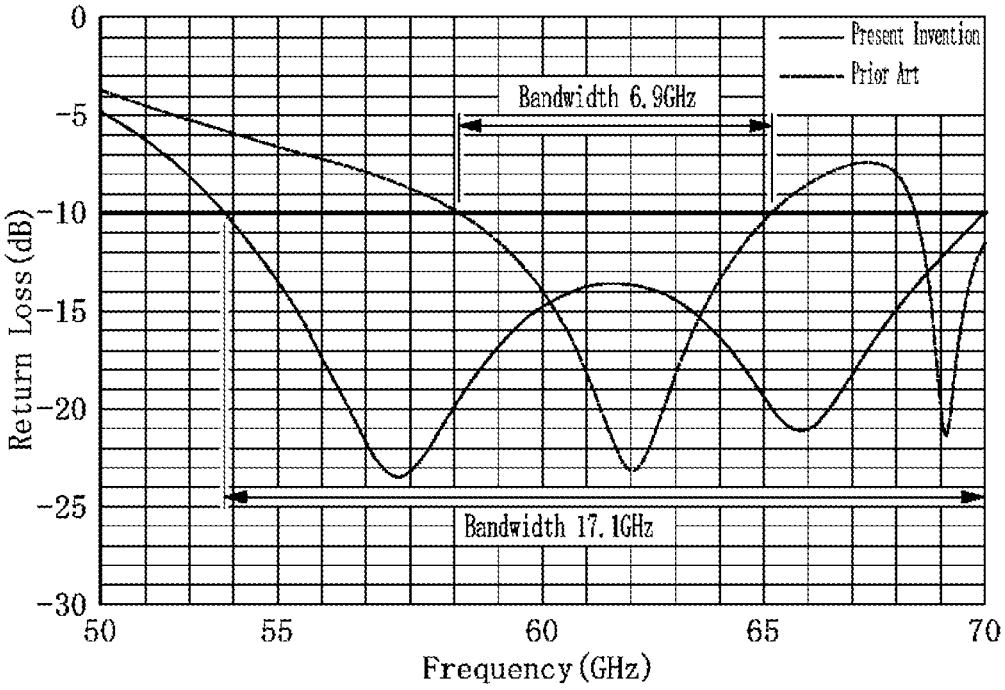
FIG. 13 is a graph showing a result of a simulation of return losses of a signal by using an analysis model by the antenna board of the present invention shown in FIGS. 12A and 12B and an analysis model by the conventional antenna board shown in FIGS. 14A and 14B.

In analysis models where the antenna board of the sixth preferred embodiment shown in FIGS. 12A and 12B and the conventional antenna board shown in FIGS. 14A and 14B were modeled, the return losses were simulated by an electromagnetic field simulator when a high-frequency signal was input into a strip conductor. The results are shown in FIG. 13. In FIG. 13, the graph indicated by the solid line is the return loss of the analysis model by the antenna board of the sixth preferred embodiment, and the graph shown by the broken line is the return loss of the analysis model by the conventional antenna board. In FIG. 13, the frequency bandwidth of the return loss of −10 dB, which is indicated by the thick graduation mark, or less is required to be as wide as possible. As is apparent in FIG. 13, in the analysis model by the conventional antenna board, the frequency bandwidth of the return loss of −10 dB or less which is required by an antenna board is a narrow bandwidth of about 6.9 GHz. In contrast, in the analysis model by the antenna board of the sixth preferred embodiment, the frequency bandwidth of the return loss of −10 dB or less is found to be a broad bandwidth of about 17.1 GHz.

As for the analysis model by the antenna board of the sixth preferred embodiment, compared with the analysis model by the antenna board of the fourth preferred embodiment, a model was used which was entirely identical with the analysis model by the antenna board of the fourth preferred embodiment except that the auxiliary patch conductors 7 were deviated to protrude 0.5 mm in the extending direction of the strip conductor 3 from the third patch conductor 4*c*.

When the auxiliary patch conductors 7 are formed so as to protrude from the third patch conductor 4*c* in the extending direction of the strip conductor 3 as in the antenna board of the fifth and sixth preferred embodiments, it is preferred that the auxiliary patch conductors 7 are deviated to the extent that the whole of the auxiliary patch conductors 7 do not protrude from the third patch conductor 4*c* in the extending direction of the strip conductor 3. This is because if the whole of the auxiliary patch conductors 7 are disposed to be deviated so as to protrude from the third patch conductor 4*c* in the extending direction of the strip conductor 3, it becomes difficult to widen the frequency bandwidth of the return loss of −10 db or less, more than the frequency bandwidths of the antenna board of the fifth and sixth preferred embodiments.

The present invention is not intended to be limited to the embodiments described above, and various modifications are possible within the scope described in the claims. Although, the patch conductors 4 and the auxiliary patch conductors 7 have quadrangle shapes in the first to sixth preferred embodiments described above, they may have other shapes such as circular shapes and polygonal shapes other than quadrangle shapes.

What is claimed is:

1. An antenna board comprising:

a first dielectric layer;

a strip conductor disposed on a top surface of the first dielectric layer so as to have an end part in a central part of the first dielectric layer, extending in one direction from an outer peripheral edge towards the end part;

a ground conductor layer disposed on a bottom surface side of the first dielectric layer;

a second dielectric layer laminated on a top surface side of the first dielectric layer and the strip conductor;

a first patch conductor disposed on a top surface of the second dielectric layer so as to cover a position of the end part of the strip conductor;

a third dielectric layer laminated on the second dielectric layer and the first patch conductor;

a second patch conductor disposed on a top surface of the third dielectric layer so that at least part of the second patch conductor covers a position where the first patch conductor is formed, being electrically independent;

a fourth dielectric layer laminated on the third dielectric layer and the second patch conductor;

a third patch conductor disposed on a top surface of the fourth dielectric layer so that at least part of the third patch conductor covers a position where the second patch conductor is formed, being electrically independent; and at least two penetration conductors connecting the end part of the strip conductor and the first patch conductor by penetrating the second dielectric layer, wherein the at least two penetration conductors align adjacent to each other in the one direction.

2. The antenna board according to claim 1, wherein a center of the second patch conductor is deviated with respect to a center of the first patch conductor in an extending direction of the strip conductor, and wherein a center of the third patch conductor is deviated with respect to the center of the second patch conductor in the extending direction of the strip conductor.

3. The antenna board according to claim 2, wherein at least one auxiliary patch conductor is disposed on each side of the third patch conductor in a direction orthogonal to an extending direction of the strip conductor on the top surface of the fourth dielectric layer so as not to cover a position where the third patch conductor is formed, and wherein the at least one auxiliary patch conductor is electrically independent of the third patch conductor.

4. The antenna board according to claim 3, wherein the at least one auxiliary patch conductor is disposed to be deviated with respect to the third patch conductor in the extending direction of the strip conductor.

5. The antenna board according to claim 2, wherein the second patch conductor is disposed so as to cover 80% or more of an area of a position where the first patch conductor is formed.

6. The antenna board according to claim 2, wherein the third patch conductor is disposed so as to cover 80% or more of an area of a position where the second patch conductor is formed.

7. The antenna board according to claim 1, wherein at least one auxiliary patch conductor is disposed on each side of the third patch conductor in a direction orthogonal to an extending direction of the strip conductor on the top surface of the fourth dielectric layer so as not to cover a position where the third patch conductor is formed, and wherein the at least one auxiliary patch conductor is electrically independent of the third patch conductor.

8. The antenna board according to claim 7, wherein the at least one auxiliary patch conductor is disposed to be deviated with respect to the third patch conductor in the extending direction of the strip conductor.

9. The antenna board according to claim 1, wherein the at least two penetration conductors are disposed so as to have a center-to-center distance of 50 to 300 μm.

* * * * *